United States Patent [19]

Bickford et al.

[11] 4,043,494

[45] Aug. 23, 1977

[54] APPARATUS FOR FEEDING A PLURALITY OF WIRES

[75] Inventors: David Edward Bickford, Harrisburg, Pa.; Robert Keith Southard, Largo, Fla.; Matthew Michael Sucheski, Harrisburg; Earl William Wagner, Annville, both of Pa.

[73] Assignee: AMP Incorporated, Harrisburg, Pa.

[21] Appl. No.: 760,219

[22] Filed: Jan. 17, 1977

Related U.S. Application Data

[63] Continuation-in-part of Ser. No. 660,565, Feb. 23, 1976, abandoned.

[51] Int. Cl.[2] ..... B65H 51/10; B65H 51/32

[52] U.S. Cl. ..... 226/109; 83/241; 83/261; 83/263; 83/282; 226/115; 226/135; 226/145; 226/146; 226/149; 226/154; 226/181

[58] Field of Search ..... 226/109, 108, 115, 135, 226/154, 150, 152, 134, 136, 181, 144, 145, 146, 149; 83/261, 272, 234, 241, 263, 280, 282

[56] References Cited

U.S. PATENT DOCUMENTS

| | | | |
|---|---|---|---|
| 2,946,588 | 7/1960 | Pityo | 226/154 X |
| 3,612,369 | 10/1971 | Grebe et al. | 226/115 X |
| 3,707,255 | 12/1972 | Ridgway et al. | 226/136 |
| 3,888,401 | 6/1975 | Minall et al. | 226/109 |
| 3,890,865 | 6/1975 | Tarbox et al. | 226/109 X |

*Primary Examiner*—Bruce H. Stoner, Jr.
*Attorney, Agent, or Firm*—Frederick W. Raring; Robert W. Pitts; Jay L. Seitchik

[57] ABSTRACT

High speed wire feeding means comprises a wire feed roll and a pressure roll, the wire feed roll being driven by a printed circuit motor under the influence of control means which maintains a high and constant level of acceleration and deceleration at the beginning and end of the feeding cycle. One embodiment has a single driven feed roll and a plurality of side-by-side pressure rolls for feeding a plurality of wires. This apparatus is capable of producing a bundle of wires having varying lengths in a minimum amount of time.

7 Claims, 13 Drawing Figures

12
14
W1
W2
W3
W4
W5
86
82
20
16
18
32
30
28
26
24
22

76
62
74
36
36
58
16
38
80
72
70a
66
70b
70c

APPARATUS FOR FEEDING A PLURALITY OF WIRES

BACKGROUND OF THE INVENTION

This application is a continuation-in-part of application Ser. No. 660,565 filed Feb. 23, 1976, now abandoned.

This invention relates to a wire measuring and feeding apparatus, the herein disclosed embodiment being directed to the achievement of high speed wire feeding methods and to an apparatus for producing bundles of wires in an extremely short time period.

There are numerous machines which are used in the electrical harness making industry which require intermittent feeding of predetermined lengths of wire or wires from an endless source such as a reel or barrel. For example, U.S. Pat. No. 3,019,679 discloses an electrical lead making machine which, during each operating cycle, feeds wire from and endless source, cuts a lead from the end of the fed wire and applies a terminal to each of the cut ends thereby to produce electrical leads which have terminals on both ends thereof. For economic reasons, it is desirable to operate lead making machines at relatively high speeds, e.g. 5000 or more leads per hour, and the achievement of a high operating speed requires that the wire feeding step be carried out in a minimum amount of time.

It is now conventional practice to design lead making machines of the general type shown in U.S. Pat. No. 3,019,679 with wire feed rolls which are driven by a conventional electric motor and to provide a motor control system which starts the motor at the beginning of the wire feeding portion of each operating cycle and stops the motor after the desired amount of wire has been fed. It will be appreciated that the acceleration and deceleration significantly effect the time required for the wire feeding portion of the cycle and that if the shortest feeding time is to be realized, the acceleration and deceleration rates must be as high as practical, particularly if comparatively short leads are being produced.

Several factors combine to limit the maximum acceleration and deceleration which can be obtained in presently available wire feeding mechanisms. One important factor is that for a given wire, there is a maximum amount of pressure which can be applied to the wire by the feed rolls, and if this maximum pressure is exceeded, the wire is deformed. The maximum allowable pressure for the wire determines the maximum rate at which the wire can be accelerated and decelerated for the reason that if the acceleration or deceleration rate is too high for a given wire pressure, there will be slippage between the wire and the rolls and the amount of the wire fed cannot be accurately measured. Finally, presently available motors and motor controls which are suitable for wire feeding do not have constant acceleration and deceleration characteristics; the motor is accelerated from start at an initially high rate but the rate decreases exponentially as the operating speedis approached. In like manner, the deceleration rate changes from an initially high rate to a low rate when the motor is stopped. It follows that when a wire feeding mechanism having motor controls of this type is started, the acceleration may be initially at the maximum level possible for the wire being fed (as determined by the maximum allowable pressure), but the acceleration immediately drops below this maximum level and decreases as the operating speed of the motor is approached. Similarly, when the feeding mechanism is stopped, the deceleration of the wire may be high during early stages of the deceleration process, but it is progressively reduced as the motor is slowed. Obviously, it would be preferably if the acceleration and deceleration could be maintained at a maximum practical level during the entire time interval of starting and stopping of the motor in order to minimize the time interval required for wire feeding.

In accordance with one aspect of the instant invention, a wire feed roll is driven by a printed circuit motor and is controlled by a controlling means which maintains a high and constant level of both acceleration and deceleration. Because of the fact that the acceleration and deceleration rates are nearly constant, a substantial reduction in the time required to feed a given length of wire is achieved. The wire being fed is held against the feed roll by a pressure roll and a wire clamp is provided which opens at the start of a feeding cycle and closes at the end of the cycle so that the amount of wire fed is precisely controlled. The means for measuring wire and producing high and ideally constant acceleration/deceleration comprises a digital controller means, linear and nonlinear control elements, motor servo controller, motor, tachometer, and position sensing means. The elements are connected so as to produce high and ideally constant acceleration on the motor until normal operating speed is reached. The digital controller and other control elements are arranged to produce the signals needed to cause deceleration of the motor at a high and ideally constant rate such that the motor will stop when the proper amount of wire has been fed. During the feeding of the wire, the elements are connected so as to form an inner velocity regulating servo loop and an outer position controlling loop. After the wire has been fed, the elements are connected to form a position regulating loop.

In accordance with a further aspect of the instant invention, the feeding means as described above is used to drive an apparatus which produces a bundle of wires of different lengths. In accordance with this aspect of the invention, a single driven feed roll is provided and a plurality of pressure rolls are associated with the feed roll, one pressure roll being provided for each wire. A programable control system controls the feed roll and the pressure rolls and the program can be changed to produce wire bundles having any desired wire lengths therein.

It is accordingly an object of the invention to provide an improved high speed wire feeding apparatus. An object is to provide an apparatus for producing bundles of wires, the individual wires in the bundle having different and precisely predetermined lengths. A further object is to provide an improved apparatus for feeding a plurality of wires which may be used in conjunction with a harness making machine or an apparatus for connected a plurality of wires to a plurality of terminals contained in electrical connectors.

These and other objects of the invention are described in preferred embodiments thereof which are briefly described in the foregoing abstract, which are described in detail below, and which are shown in the accompanying drawing in which.

Figure 3:
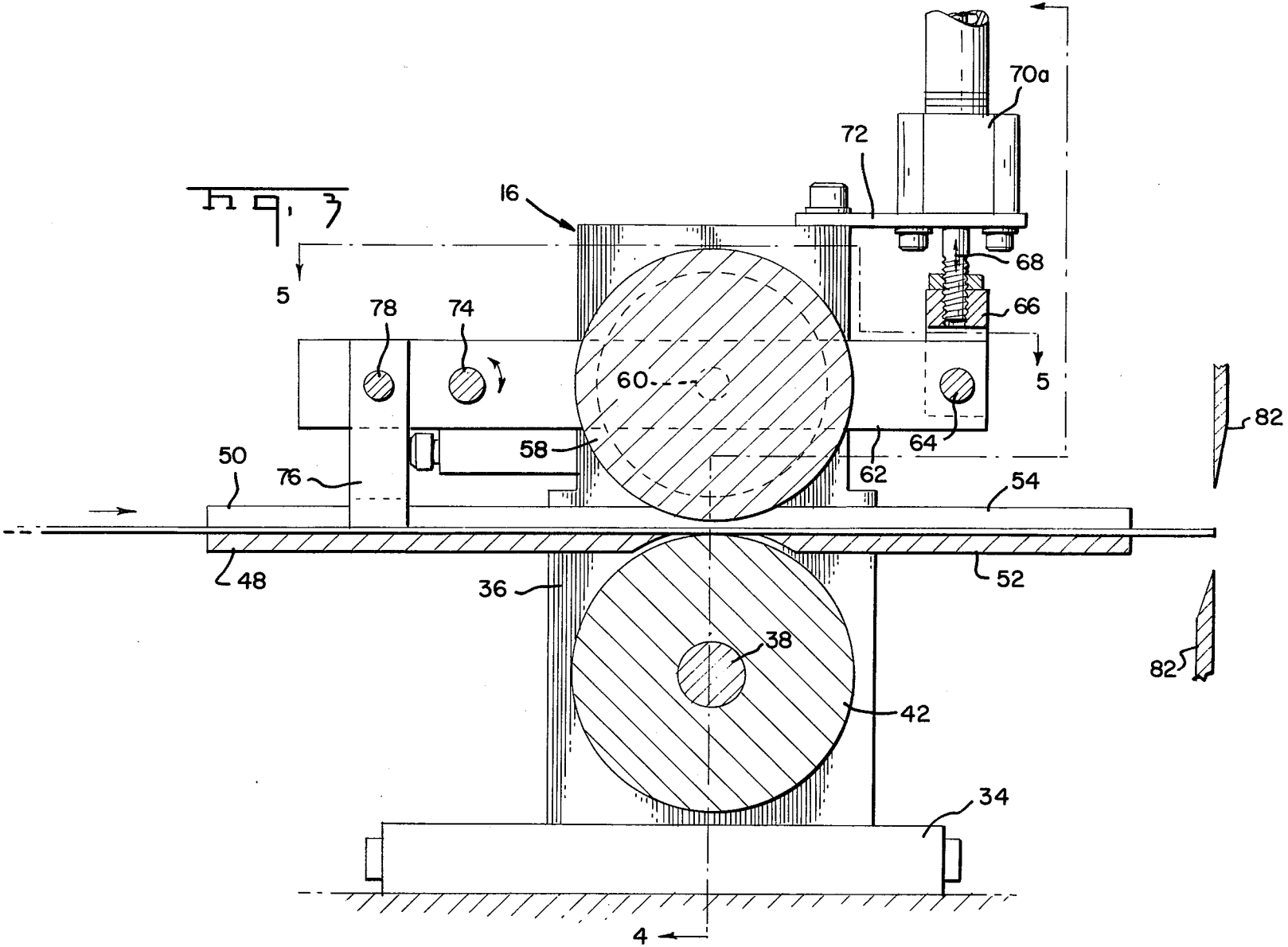
FIG. 3 is a sectional side view of the wire feeding means of the apparatus of FIG. 2.
Figure 4:
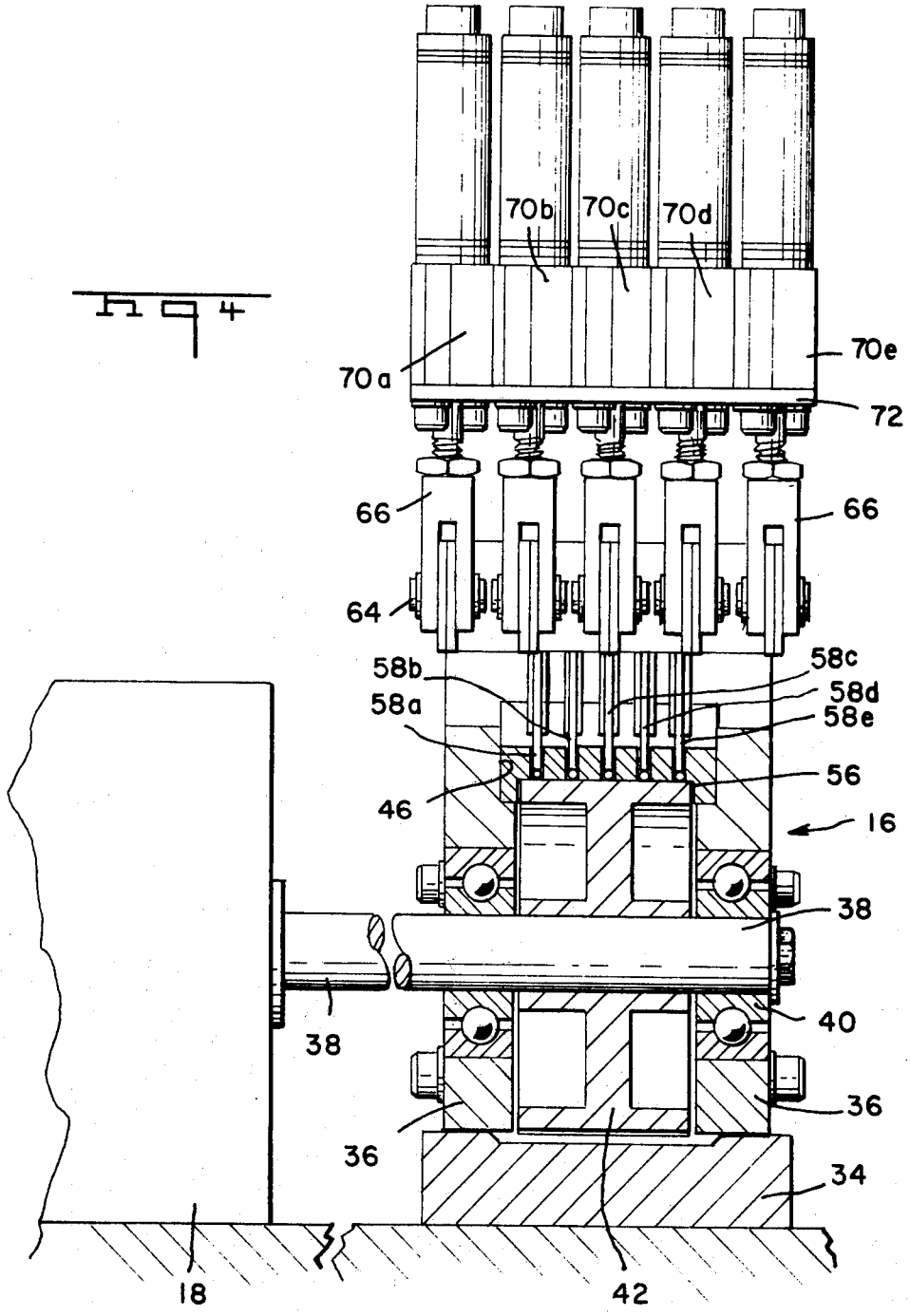
Figure 5:
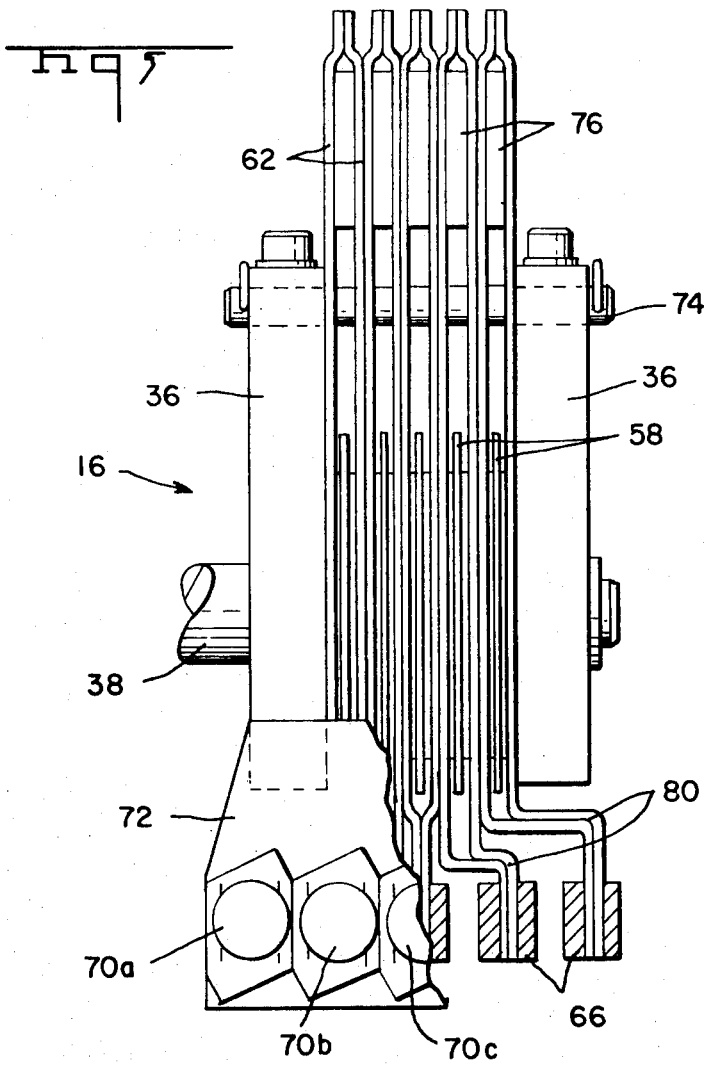

FIGS. 4 and 5 are views taken along the lines 4—4 and 5—5 of FIG. 3.

Figure 6:
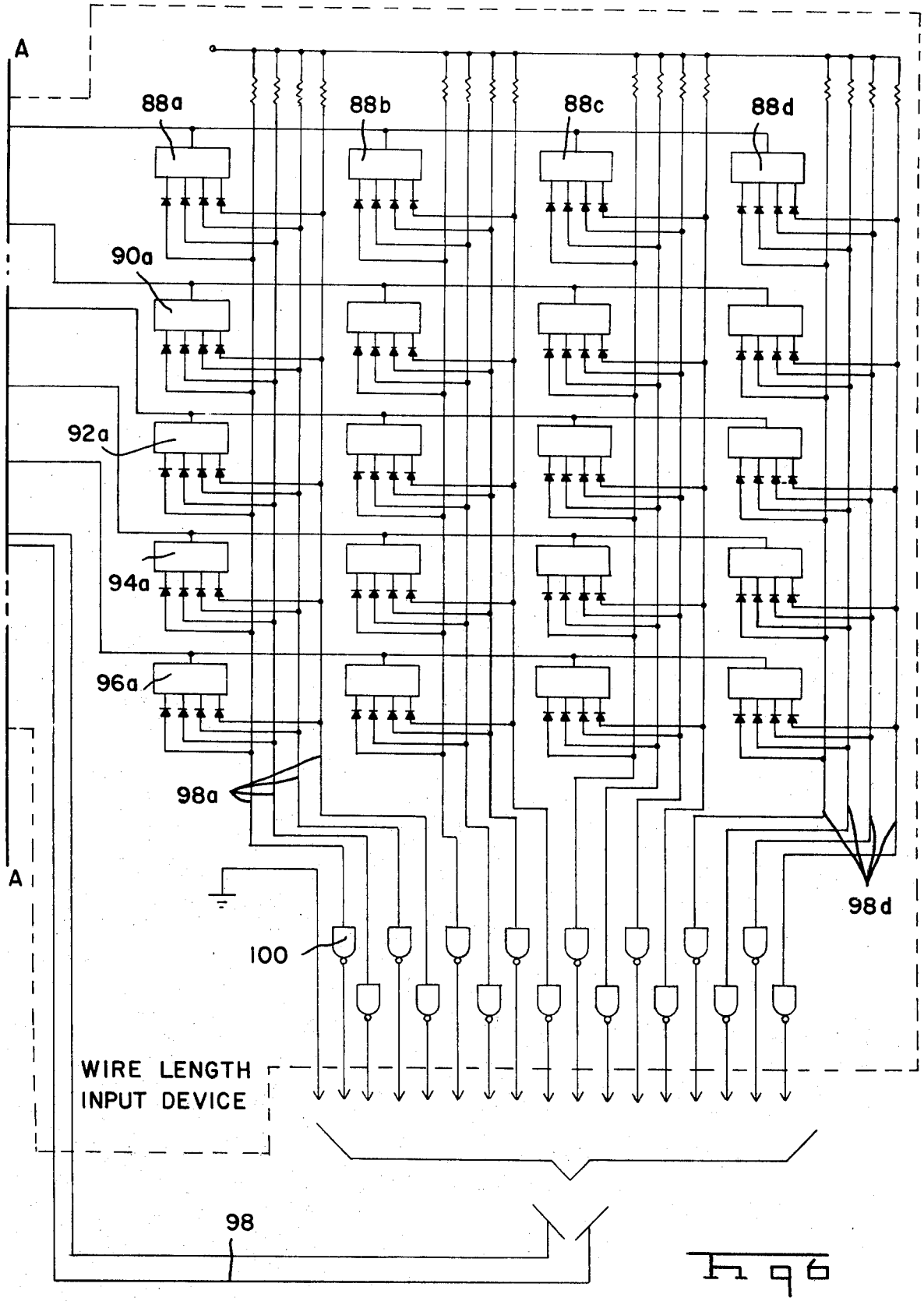
Figure 6A:
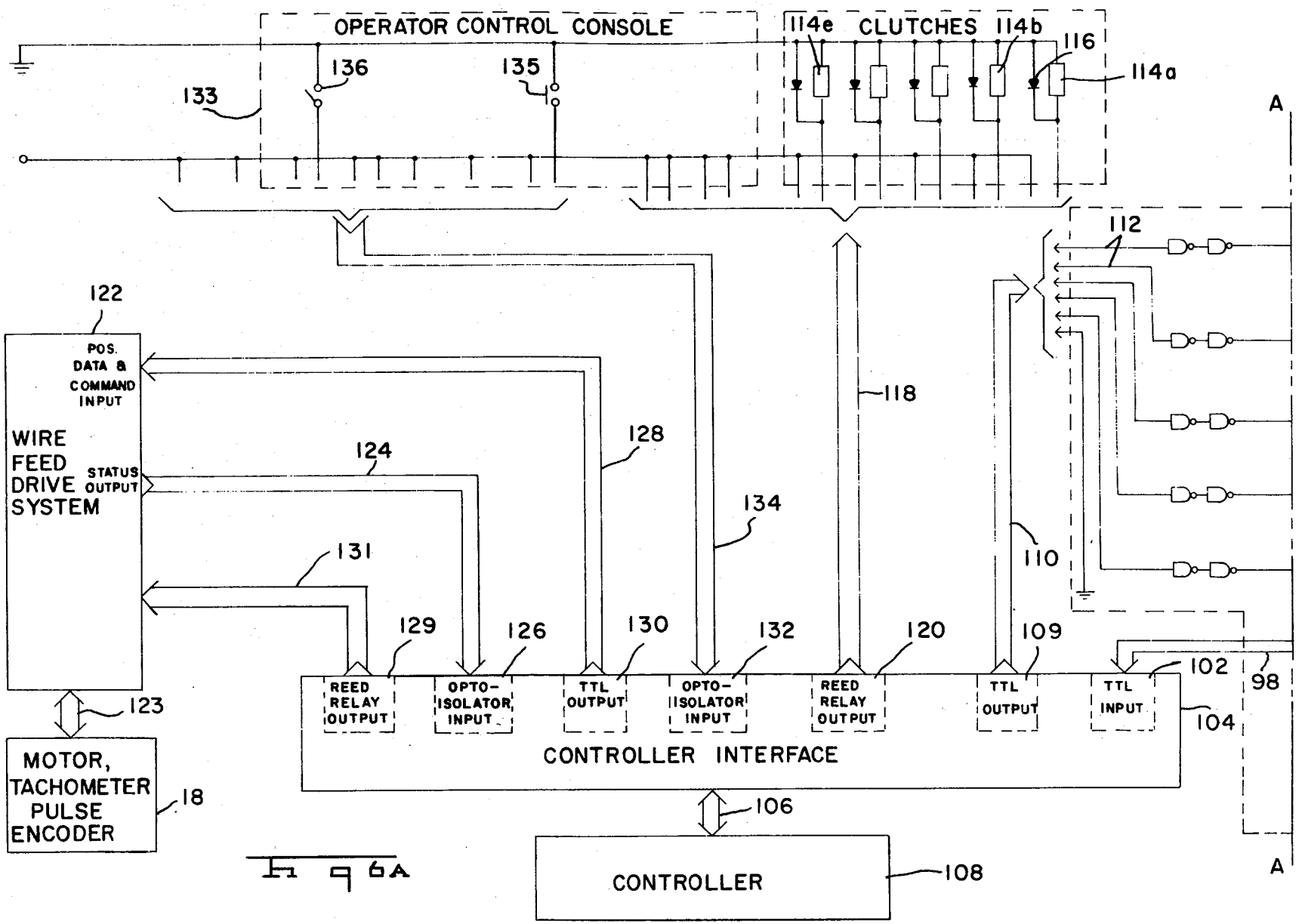

FIG. 6 and 6A present a block and schematic diagram representation of the control means for the apparatus; these two Figures can be arranged against each other along the lines A—A to show the entire diagram.

Figure 7:
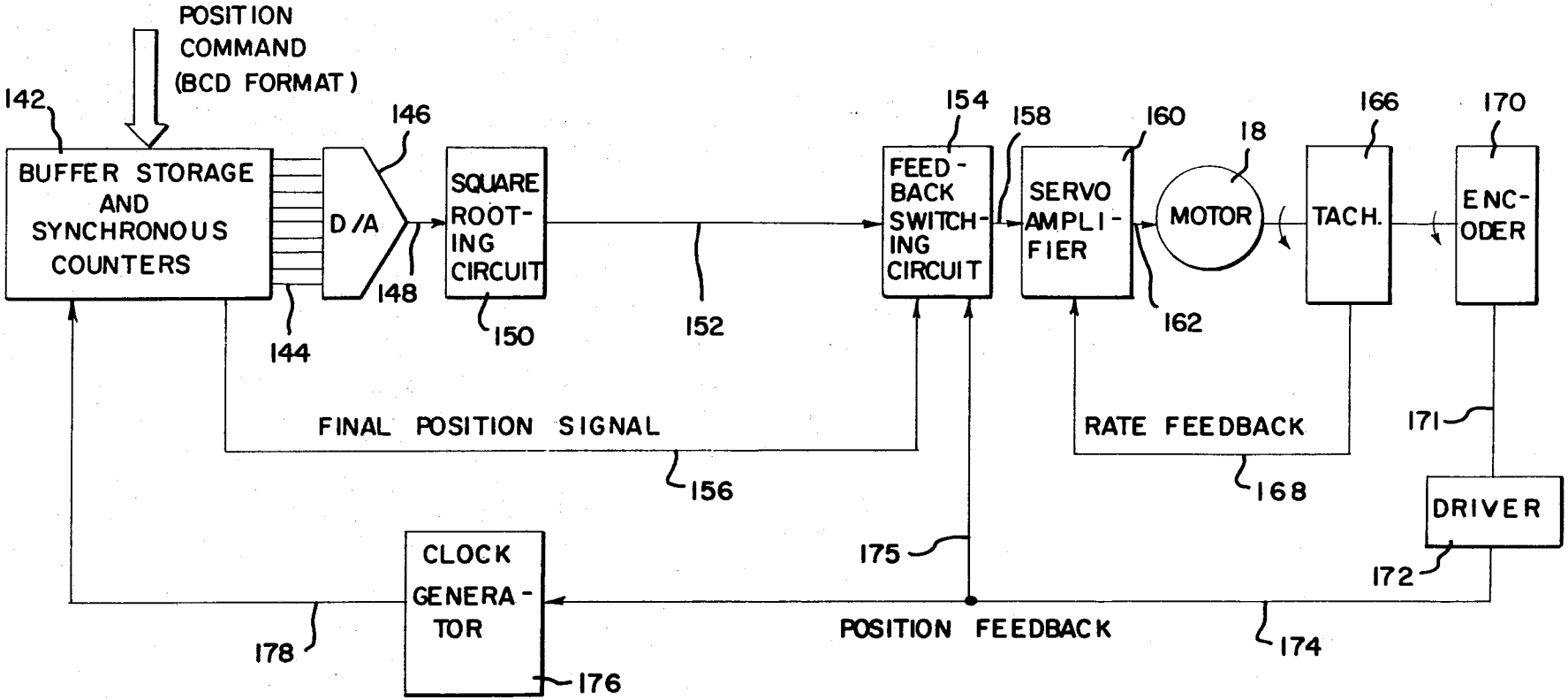

FIG. 7 is a schematic wiring diagram of the motor drive system of the apparatus.

Figures 1, 2:
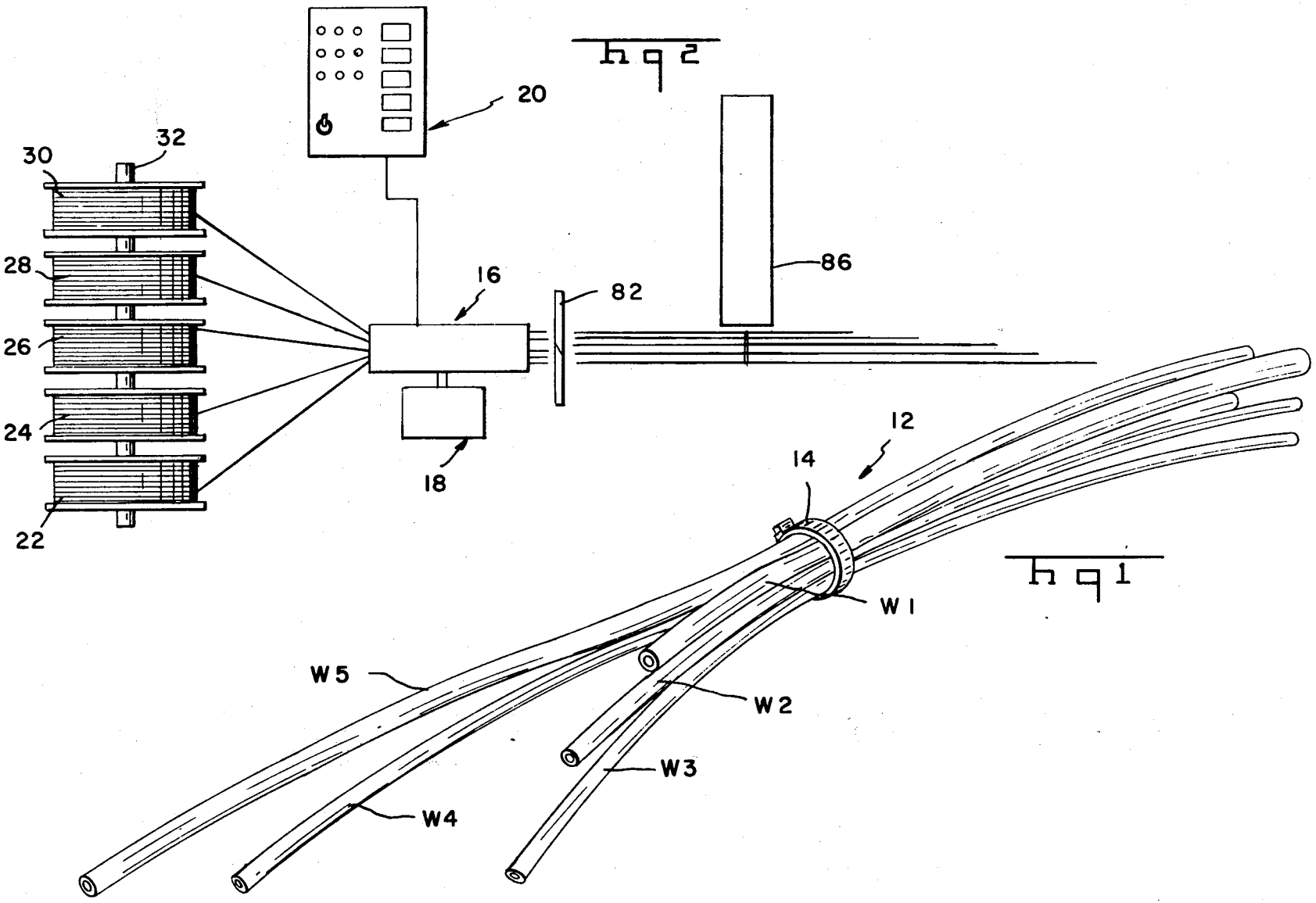
FIG. 1 is a perspective view of a bundle of wires produced by one form of apparatus in accordance with the invention.
FIG. 2 is a diagramatic plan view of an apparatus in accordance with the invention.
Figure 8:
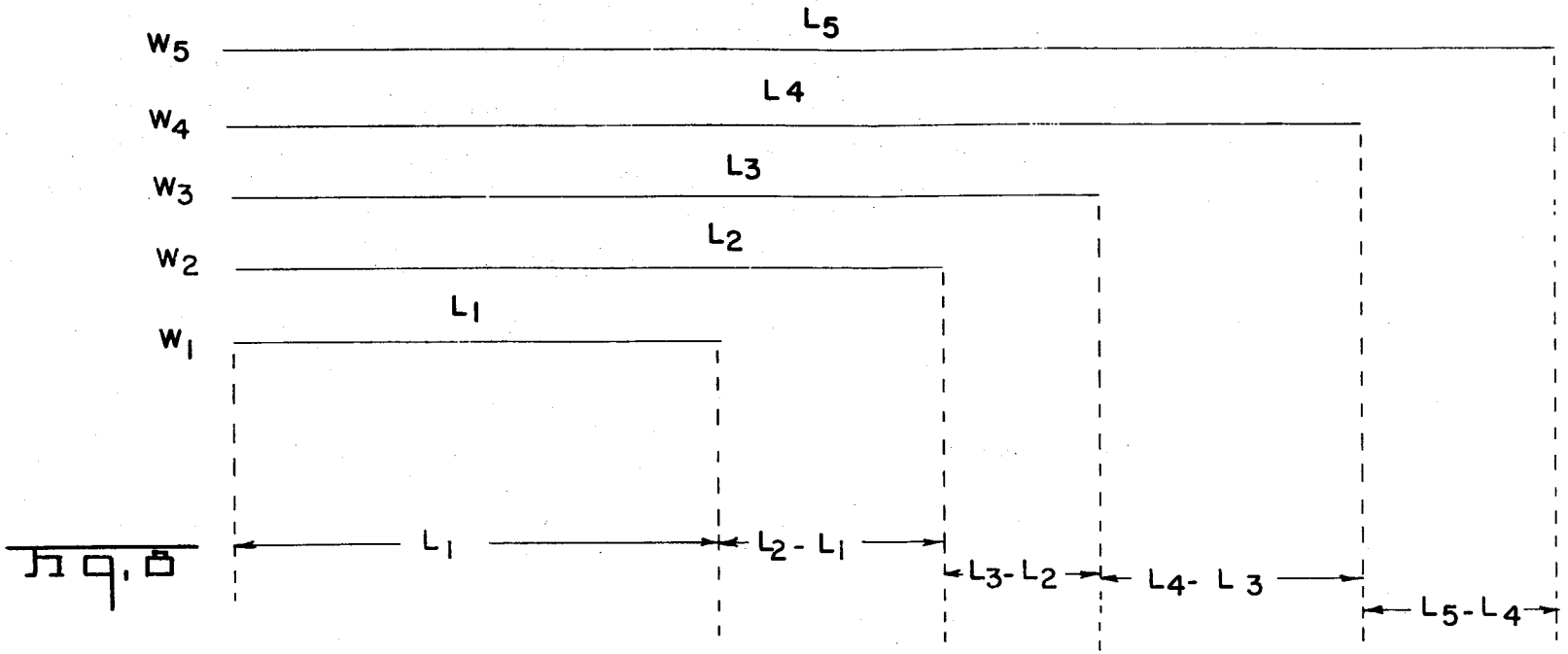

FIG. 8 is a diagram which illustrates the feeding steps which are followed to produce a bundle of five wires as shown in FIG.1 having different predetermined lengths.

Figure 8A:
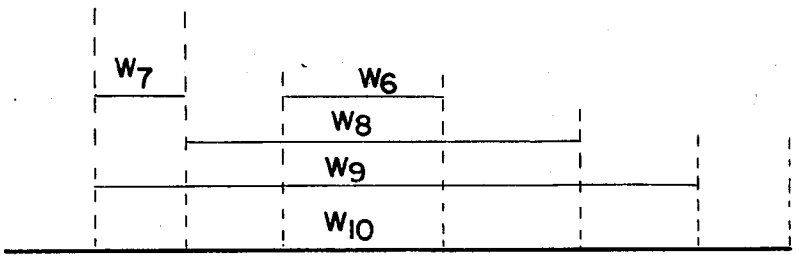

FIG. 8A is a diagram which illustrates the feeding steps for feeding an alternative bundle.

Figure 9:
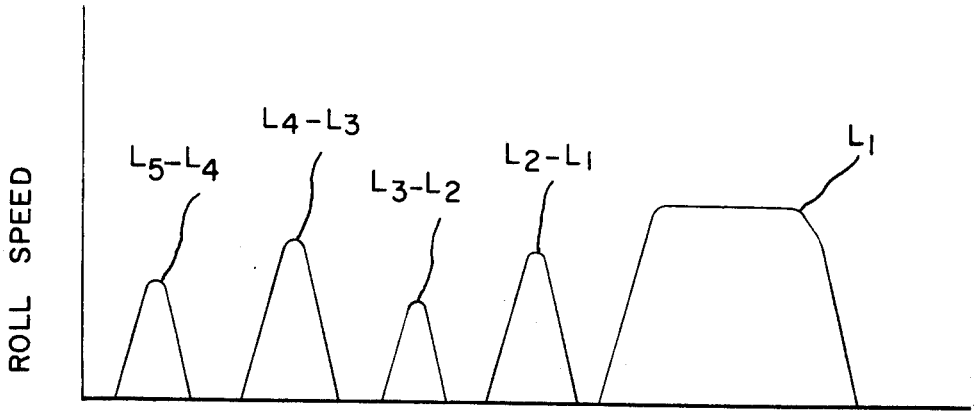

FIG. 9 is a curve which illustrates the speed of the feed roll during several feeding steps to produce a bundle containing wires of different lengths as shown in FIG. 1.

Figure 10:
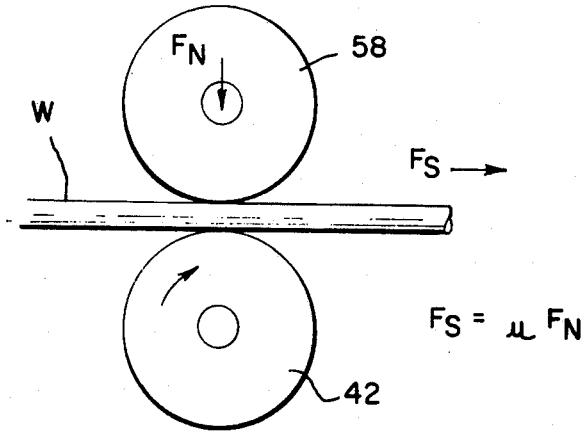

FIG. 10 is a digramatic view of a pressure roll and a feed roll in contact with a wire showing the forces which act on the wire during feeding.

Figure 11:
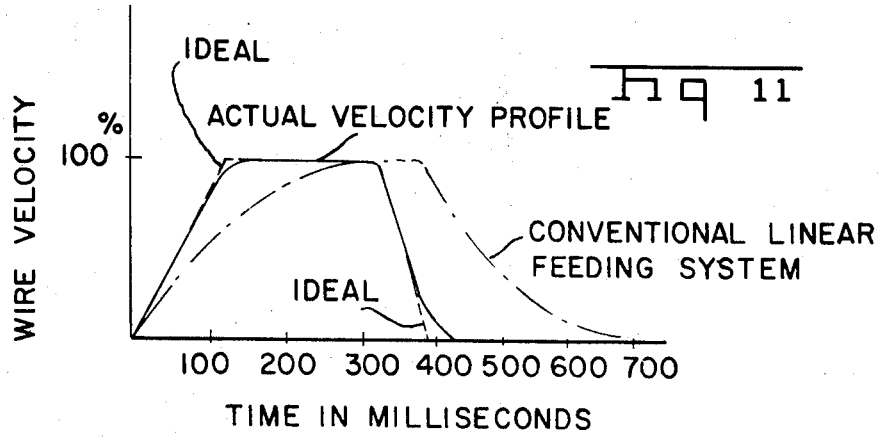

FIG. 11 shows seed-time curves for electrical drive motors for wire feed rolls.

FIGS. 2-6 show an embodiment of the invention which is capable of producing bundles 12 (FIG. 1) of wires $W_1$, $W_2$, $W_3$, $W_4$, $W_5$ which may be held together by a bundle tie device 14. The wires of the bundle are of different predetermined lengths $W_1$ being the shortest wire and $W_5$ being the longest wire, and the wires may be different types of diameters as desired. The right-hand ends of the wires are aligned with each other although the lefthand ends are not but, as will be explained below, the wires of different lengths in a bundle can be located in any desired positions by properly programming the controlling means. Bundles of the types shown in FIG. 1 can be used in the harness making industry in that the ends of the individual wires can be crimped onto terminals to form the finished harness.

The apparatus comprises a wire feeding means 16, a drive motor 18, and controlling and programming means 20 which can be programmed to produce a bundle of any desired combination of wire lengths. The wires are drawn from separate substantially endless sources such as spools or reels 22, 24, 26, 28 and 30 which are mounted on a common axis 32. The wires extend from these sources to the feeding means 16 and the previously fed wires extend rightwardly in FIG. 2 from the feeding means. A suitble wire cutter 82 is provided to sever the fed wires and the bundle tie device is applied by a suitable bundle tie applicator 86.

As shown in FIGS. 3-5, the feed means 16 comprise a frame having a base 34 and parallel sidewalls 36 in which bearings 40 are mounted to support the shaft 38 of the motor 18. A single relatively wide feed roll 42 is keyed or otherwise secured to the shaft 38. The opposed surfaces of the sidewalls 36 are cut away in their upper portions as shown at 46 for the reception of lower inlet and outlet guides 48, 52 and upper inlet and outlet guides 50, 54. The lower guides 48, 52 provide flat surfaces which guide the wires to the feed roll so that the wires are in a side-by-side, parallel relationship adjacent to the uppermost portion of the surface of this roll. The upper guides 50, 54 have parallel spaced apart grooves 56 which permitthe pressure rolls and wire clamps, described below, the engage the individual wires during operation.

A separate pressure roll 58 is provided for each wire, these rolls being identified by the reference characters 58*a*–58*e* and each roll is received in the groove 56 in which its associated wire is located. Each roll is rotatably mounted on a pivot pin 60 which is supported in a lever 62 comprising two spaced apart bars as shown best in FIG. 5. The levers 62 extend rightwrdly as viewed in FIG. 3 beyond the sidewalls 36 and each lever is pivotally connected at 64 to a yoke 66 which is mounted on the end of a piston rod 68 which extends from a respective pneumatic piston cylinder 70*a*–70*e*.

Each lever 62 extends leftwardly as viewed in FIG. 3 and is pivotally supported for rotation on a rod 74 which extends between the sidewalls. A wire clamping member 76 is secured by fasteners 78 to the end of each lever and extends downwardly towards inlet guide 48 and between the opposed sides of one of the grooves 50. The levers 62 are normally at the limit of their counterclockwise movement with respect to the pivotal axis 74 and the clamping members 76 are normally against the wires so that the wires are firmly clamped against the surface of the guide 48. Also, the individual pressure rolls are normally out of engagement with, that is spaced from, the wires so that rotation of the feed roll 42 does not result in feeding of the clamped wires. The wires can be selectively fed by pressurizing the appropriate one of the piston cylinders 70*a*–70*e* and immediately thereafter starting the motor 18 so that the wire is unclamped and the pressure roll urges the wire against the surface of the feed roll. It will thus be apparent that all of the wires can be fed at one time or an individual wire or combination of wires can be fed by pressurizing all or selected ones of the cylinders 70*a*–70*e*.

At this juncture, and before proceeding to describe the control system for the apparatus, it should be explained that the wire bundle 12 is produced by several wire feeding steps which are illustrated in FIG. 8. As shown in this Figure, during the first feeding step, the pressure roll 58*e* for wire $W_5$ is first engage with $W_5$ and the motor 18 is then started and operated for a time period sufficient to feed wire $W_5$ a distance equal to $L_5-L_4$, $L_5$ and $L_4$ being the lengths of wires $W_5$ and $W_4$ respectively. The motor is stopped after this wire increment has been fed and during the next portion of the feeding process, both $W_5$ and $W_4$ are fed a distance equal to $L_4-L_3$. In the third feeding step $L_5$, $L_4$ and $L_3$ are similarly fed a distance $L_3-L_2$ while in the fourth feeding step, $W_5$, $W_4$, $W_3$, and $W_2$ are fed a distance equal to $L_2-L_1$. In the final portion of the feeding process, all of the wires are fed a distance $L_1$ and the wires will extend from the feeding apparatus as an array in accordance with FIG. 8. During each feeding interval, the feed motor 18 is started and stopped for reasons which will become apparent from the following description of the control mechanism. It should be mentioned that the order of feeding the wires could be reversed from that shown and described.

After the feeding steps have been carried out, the wires are cut by the cut-off device 82 and a bundle tie device 14 is applied to the wires as shown in FIG. 1. As previously mentioned, the bundle of wires 12 would be useful in harness manufacturing processes or otherwise. It should also be mentioned that virtually any desired form of bundle might be produced by the use of a properly designed wire feeding program, and a bundle can be produced in which the wire ends are not aligned at one end of the bundle as in FIG. 1. The bundle of FIG.

1 is shown to illustrate the principles of the invention for reasons of simplicity.

Referring now to FIGS. 6, 6A and 7 the operation of the apparatus is under the control of a controller 108 which may take the form of a computer, a microprocessor, a hard wired logic means, a programable controller or any combination of the foregoing. For example, a model 1220 digital computer manufactured by Data General Company of Southboro, Mass. can be used although a computer of this type will not always be required since it has capabilities which exceed by far the requirements of many circumstances under which the invention will be used. The function of the controller 108 is to tie together the several subsystems described below, to receive signals from the sub-systems, produce signals for transmission to the sub-systems, to operate the feeding apparatus and to coordinate the timing and the operation of the different components of the apparatus. The controller thus makes logical decisions as to which of the several cylinders 70*a*–70*e* must be pressurized and in what sequence they must be pressurized. The controller interprets signals from the operator console and is capable of performing the arithmetic computations ($L_1 - L_2$ etc.) required to produce a wire bundle of given specifications.

The controller 108 is coupled as shown at 106 to a controller interface 104 which serves to convert the voltage logic level signals of controller 108 to the other voltage logic signals and logic types of the sub-systems. The controller interface 104 is thus a digital input output system and may, for example, be of the type produced by Date General Corporation of Southboro, Mass. model 5602.

The lenghts of the wires $W_1$ to $W_5$ is determined by setting five separate binary coded decimal thumbwheel switches. Each switch can be set for four digits as indicated by the identifying letters, eg. 88*a*, 88*b*, 88*c*, 88*d*. The switches are connected to common buss conductors 98 which extend throgh logic gates 100 to the TTL (transistor - transistor logic) input card of the controller interface 104. The logic gates 100 are simply voltage level converters which are required if the switches operate at higher voltages than the controller interface input 102. The controller interface is also connected through the TTL output 109 thereof to the switches as shown at 110, these connections including individual select lines 112 which extend to the individual switches as shown. These select lines 112 are used to multiplex data from the switches onto the wires 98 so that the switches may be sequentially examined by the controller 108. The lengths of the several wires $W_1$ to $W_5$ in the bundle are thus determined by simply setting the switches so that the information in the switches can be transmitted through the interface 104 to the controller 108 which determines the optimum wire feeding sequence from this information. The individual piston cylinders 70 are selectively pressurized by solenoid air valves 114*a* to 114*e* which are coupled to a reed relay output section 120 of the controller interface 104 by conductors 118. Advantageously, diodes 116 are connected in parallel with the air valves for noise suppression purposes.

An operator control console 133 is provided and contains the control switches and lights for the apparatus. Some of these controls may be of the manual type such as a jog button 136 and a manual wire feed control 135 as described below. In addition, the console will contain "on-off" controls, a "start-stop" control, a "job-run-select" switch, and indicator lights to indicate machine status and condition. Only the jog button 136 and the manual feed switch 135 are specifically shown in the drawing and only the leads for some other controls are shown in FIG. 6A.

A manual wire feed mode is provided to feed all the wires simultaneously at a predetermined speed. This manual feed would be used primarily during set-up of the apparatus and is controlled by a reed relay output 129 from the controller interface 104 and is connected to the wire feed drive system as shown at 131. When the manual wire feed button 135 in the console 133 is depressed, all of the wire feed clutches 114*a*–114*e* are energized and the motor is also energized. The reed relay output 129 serves to select the manual wire feed mode for the manual wire feed system.

The motor 18 is controlled by motor control circuit means 122 which is connected to a TTL output 130 of the interface 104 as shown at 128. The inputs for the motor control 122 will comprise command inputs as described below and the outputs of control 122 will comprise status data which is transmitted through lines 124 to an opto isolator input 126 of interface 104. This input converts the 24 volt signals to 5 volt signals which are passed through the interface 104 to the controller 108. These signals pass to the controller 108 status information, particularly, when the wire feed increment is complete.

The motor 18 comprises a printed circuit motor which is an ideal type in that it has very low inertia so that it can be started and stopped in an extremely short time interval. The drive roll 42 and other mechanical elements should be designed so that their inertia is low. The motor assembly includes a tachometer which can monitor motor speed and a rotary encoder which monitors the angular displacement of the motor and hence the amount of wire fed.

The drive motor 18 and control system 122 receives information through line 128 regarding the amount of wire which is to be fed during each feeding step in the operation of the apparatus. The information thus received is stored and during the feeding step, the controller causes the motor 18 to turn the feed roll 42 through a number of revolutions which will effect feeding of th desired length of wire. Advantageously, the controlling circuitry is such that it will accelerate the motor during start-up at a relatively high and ideally constant rate to a normal operating speed, run the motor at this operating speed and then decelerate the motor at a high and ideally constant rate until the motor is stopped. The constant rate acceleration and deceleration is desirable in order to accomplish the wire feeding in a minimum time interval. One commercially available position control apparatus which can be used to control the motor is the System 500 manufactured by Control System Research Inc. of Pittsburgh, PA. A block diagram of the System 500 control means is shown in FIG. 7 and described below.

The control system comprises a buffer storage and synchronous counter 142 which receives and stores information passed through the lines 128. The buffer storage has output lines 144 which extend to a digital-to-analog converter 146 and the output 148 of this converter passes to a square rooting circuit 150. Square rooting circuit is connected by a line 152 to a feed back switching circuit 154 and this switching circuit has an output line 158 extended to a servo-amplifier 160 which supplies power through a line 162 to the previously identified motor 18. Motor 18 has a tachometer 166 and an encoder 170 on its shaft, the tachometer 166 being connected by a line 168 to the servo-amplifier 160 and the encoder 170 being connected by a line 171 to a driver 172. The line 174 extends from the driver to a clock generator 176 and a further line 178 extends from the clock generator to the synchronous counter 142. It should also be noted that the output of the driver 172 is passed to the feed back switching circuit 154 by a line 175. The synchronous counter 142 is also connected by a line 156 to the switching circuit 154.

During a given feed cycle, the buffer storage 142 will receive information requiring the feeding of a predetermined amount of wire which in turn requires a predetermined number of revolutions of the feed motor 18. The synchronous counter 142 produces an error signal (which is proportional to the amount of wire remaining to be fed) which is passed in lines 144 to the digital-to-analog converter 146. The output signal of this converter passes through line 148 to the square rooting circuit 150 and the signal from this circuit passes through line 152 to the feed back switching circuit 154. The square rooting circuit 150 provides the required nonlinear transformation to allow deceleration to occur properly. During feeding of the wire, a signal is passed from the buffer storage 142 through the line 156 to the feed back switching circuit 154 to cause the switching circuit to pass the signal in line 152 through line 158 to the servo-amplifier 160. The servo-amplifier in response to this signal supplies power in line 162 to the motor 18 thereby to rotate the feed wheel and feed the wire. The speed of the motor is controlled by a speed control servo-loop comprising the tachometer 166, the feed back line 168 to the servo-amplifier, the servo-amplifier 160 and the motor 18.

During feeding, the encoder 170 generates incremental signals which are passed through line 171 and amplified in the driver 172. These incremental signals are passed through the line 174 to the clock generator 176. They are also passed into the feed back switching circuit 154. During wire feeding, they are blocked by the switching circuit so long as the final position signal 156 indicates that some wire remains to be fed. The signal supplied from the driver 172 to the clock generator produces signals for passage through line 178 to the synchronous counter 172. These signals incrementally decrease or "decrement" the buffer storage 142. In other words, the signals passed through the line 178 update the synchronous counter as to the amount of wire which has been fed and the synchronous counter responds by appropriately changing the error signal passing throgh the lines 144.

After all of the wire has been fed, the final position signal passed through line 156 causes the feed back switching circuit 154 to pass any signals from the encoder 170 through the line 158 to the servo-amplifier. After the completion of feeding of the wire, the feed back switching circuit 154, the servo-amplifier 160, the motor 18, the encoder 170 and the signals passed through the lines 171, 174, and 175 constitute a final position regulation loop for the shaft of the motor and, therefore, the position of the feed wheel.

The wire measuring and feeding means of the disclosed embodiment of the instant invention can be generally and concisely described as comprising a digital controller, linear and non-linear control elements, motor servo-controller means, a motor, a tachometer, and position sensing means (the term "position" being used to denote the amount of wire which has been fed). These elements are connected so as to produce high and ideally constant acceleration of the motor until its normal operating speed is reached. The digital controller and other control elements are arranged also to produce the signals needed to cause deceleration of the motor at a high and ideally constant rate such that the motor will stop when the proper amount of wire has been fed. During the feeding of the wire, the elements are connected so as to form an inner velocity regulating servo-loop and an outer position controlling loop. After the wire has been fed for a given cycle, the elements are connected to form a position regulating loop.

The term "ideally constant" has been advisedly used above to describe the acceleration and deceleration characteristics of the motor. Usually, the acceleration will not be precisely constant but will change somewhat during starting and stopping of the motor as shown in FIG. 11 in which wire feeding velocity is plotted against time in milliseconds required to feed a wire 100 inches long for a feed mechanism in accordance with the invention and for a feed mechanism having conventional controls. The curve for the ideally constant acceleration feed mechanism is based on observed data while the curve for a conventional motor control is based primarily upon published motor performance data.

It can be seen that when a wire feed means in accordance with the invention is operated, the wire velocity increases at start up at a substantially constant rate but then the acceleration drops off somewhat as the normal operating speed is approached. During deceleration, there is a linear decrease in velocity at first but toward the end of the deceleration portion of the cycle, there is a departure from linearity. The ideal linear velocities are shown by labled dotted lines and the actual velocities (i.e. the velocity profile) are shown with solid lines. The departure from linearity is primarily due to the fact that the power supply is incapable of supplying the maximum current called for during the final portion of the acceleration portion of the cycle and the final portion of the deceleration portion. A closer approach to the ideal curve for the practice of the invention could be achieved by using a larger power supply, however, the actual capacity of the power supply will be a matter of choice as dictated by economic conditions. An extremely high acceleration rate and deceleration rate as shown in FIG. 11 will quite often be sufficient to the extent that further expenditure for a more sophisticated power supply would not be justified. In any event, it is apparent from FIG. 11 that the feeding interval required for a feeding and measuring means in accordance with the invention is greatly reduced as compared with that required by a conventional motor control system. It should also be mentioned that the deviation from ideal conditions shown in FIG. 11 would not be nearly so pronounced if the wire length being fed were relatively short, say about 3 inches. A closer approach to ideal conditions can be achieved with short leads being fed because of the fact the power supply used in the embodiment described can provide about 50 milliseconds of full acceleration before deterioration. In any event, FIG. 11 and the data presented above will serve to point out the extraordinary feeding characteristics of the invention if it is observed that 100 inches of wire can be fed in slightly over 400 milliseconds and the wire will be fed for a brief interval at a velocity of 300 inches per second.

When only a short length of wire is being fed during a particular feeding step, the feed roll may not attain its normal steady state operating speed but will simply accelerate to some speed which is lower than the steady state speed and immediately thereafter decelerate until it comes to rest. FIG. 9 shows an idealized speed vs. time curve for the feed roll during the successive feeding steps required to produce a bundle of the tupe shown in FIG. 1 where the differences ($L_5-L_4$; $L_4-L_3$ etc.) are relatively slight and the shortest wire $L_1$ is a length whih permits the feed roll to achieve its normal operating speed and maintain that speed for a significant time interval. The feed roll achieves its normal speed only while the length L, is being fed but in all of the other feeding steps, the feed roll merely accelerates to a lesser speed and decelerates to a stop. The deceleration part of each curve is slightly steeper than the acceleration part. If is of interest to note that if $L_1$ is about 100 inches and the difference ($L_5-L_4$ etc.) are of the order of 3 inches, the total time required to feed the bundle is only about 2 seconds which includes the intervals between feeding steps.

FIG. 10 illustrates the frictional relationships which exist between a wire W being fed and the rolls 42 (the driven feed roll) and 58 (the pressure roll). The pressure roll 58 is urged against the wire by a force $F_n$ which can be set at any desired level. The force of static friction $F_s$ between the wire and the rolls is dependent upon $F_n$ in accordance with the equation $F_s=\mu F_n$ where $\mu$ is the coefficient of friction.

As previously explained, the upper limit of acceleration when a given wire is fed by a set of feed rolls is the highest level which will not result in slippage between the wire and the feed roll 42 and the magnitude of this level of acceleration is directly dependent upon the force of static friction $F_s$. It might appear that $F_s$ could be raised to any desired level by increasing the normal force $F_n$ but there is an upper limit for $F_n$ since the wire could be permanently deformed if $F_n$ were raised to an unduly high level and even elastic or resilient deformation might be objectionable in that an error in rotation of rotary encoder could be introduced because of the reduced cross sectional area of wire.

In order to feed a given amount of wire in a minimum amount of time, the acceleration of the feed roll should be established at a maximum practical acceleration level in the light of the friction and force considerations discussed above. The advantage of Applicants' drive mechanism for the feed roll is that this high and ideally constant acceleration rate can be maintained through a substantial portion of the feed cycle while the wire and feed rolls are accelerated to the constant running speed of the motor. During deceleration, a high and ideally constant rate can similarly be maintained. When a prior art type motor control is used for the feed roll, however, the maximum practical acceleration rate of the motor is obtained only during the small portion of the acceleration part of the curve of FIG. 11 and lower acceleration rates exist through most of the time period during which the motor is being brought up to its operating speed. The deceleration portion of the curve is similarly non-linear in that maximum deceleration of the feed roll takes place only during a portion of the deceleration as also shown in FIG. 11.

FIG. 11 compares a control system in accordance with the invention with a prior art motor control system in an unfavorable light in that the motor is driven for a significant time interval at its constant running speed. Even under these circumstances, there is a significant reduction in the time required for the wire feeding cycle when a speed control in accordance with the invention is used. If the length of wire being fed were only about 10 inches instead of 100 inches, the advantages of the instant invention would be much more impressive.

Specific performance data are presented below for the wire feeding mechanism specifically described herein when programmed to feed a wire 100 inches long. These data were used to plot the curve shown in FIG. 11.

Max. wire velocity: 300 in./sec.
Max. angular velocity: 251 rad/sec.
Max. wire acceleration: 3000 in./sec.2
Max. angular acceleration: 2513 rad/sec.2
Max. torque delivered by motor: 545 oz.in.
Total inertia: 0.217 oz.-in.-sec.$^2$
Max. wire deceleration: 3530 in./sec.$^2$
Max. angular deceleration: 2960 rad/sec.$^2$
Time to change value of acceleration: 1 msec.

It should be noted that the acceleration changes from zero to the maximum of 3000 inches per second in about 1 millisecond, this rapid change being achieved by virtue of the very low armature inductance of the printed circuit motor. A shift from running at constant speed, (or acceleration) to deceleration can be equally rapid.

The herein disclosed invention incorporating control means for a wire feed wheel and the mechanical means for engaging wires with the feed wheel and stopping or clamping the wires can be used for a wide variety of purposes other than merely the production of wire bundles. For example, the bundles shown in FIG. 8A can be produced by appropriate programming of the apparatus. In this Figure, none of the ends of the wires $W_6$–$W_{10}$ are aligned as they are in the bundle of FIG. 8. The bundle of FIG. 8A can be produced by programming the apparatus such that the wires are fed in 7 separate feeding steps, as indicated in the drawing. It should be noted that one wire, $W_7$, is in alignment with, but spaced from, another wire $W_6$ in the bundle. Wires might be fed as shown in FIG. 8 in an automatic harness making apparatus or might be bundled as peviously described.

The electronic control features of the invention might be used to control a single pressure and feed roll combination to feed a single wire rather than multiple wires as described above. The rapid acceleration and deceleration characteristics will provide significant advantages over conventional motor controls for wire feed devices.

It is mentioned above that the herein disclosed embodiment must be constructed such that there is no slippage of the feed roll relative to the wire. The reason for this requirement is that the wire is metered by the feed roll and slippage would introduce an error into the length of wire fed. If desired, however, the rotary encoder which measures the amount of wire fed could be coupled to the pressure roll or otherwise coupled to the wire rather than the motor and under these alternative circumstances, slippage between drive roll and wire would not introduce an error into the metering of the wire. In the instant embodiment, the provision of a separate rotary encoder for each of the wires would increase the cost of the apparatus because of duplication of these parts.

The printed circuit motor described above is well suited to the practice of the invention but other types of motors might be used, for example, a hollow core armature type motor. Many other modifications and substitutions could be used without departure from the spirit and scope of the invention herein disclosed. For example, the wire length inputs can be produced from alternative sources such as a tape reader, magnetic tape, or a control computer which might be controlling a manufacturing process of which the instant apparatus would comprise one element.

A feeding means in accordance with the invention will feed wires of different gauges without loss of accuracy since there is a separate pressure roller for each wire.

Changes in construction will occur to those skilled in the art and various apparently different modifications and embodiments may be made without departing from the scope of the invention. The matter set forth in the foregoing description and accompanying drawings is offered by way of illustration only.

What is claimed is:

1. Wire feeding apparatus comprising:

a wire feed roll, said feed roll having a width which is sufficient to receive a plurality of wires in side-by-side parallel relationship, motor means for rotating said feed roll, a plurality of pressure rolls, said pressure rolls being mounted on axes which extend parallel to the axis of said feed roll, each of said pressure rolls having a non-feeding position, in which it is spaced from said feed roll, and being individually movable towards said feed roll to a wire feeding position, wire guide means, said guide means being effective to guide wires from substantially endless source means towards said feed roll and position one wire between said feed roll and each of said pressure rolls and control means for starting and stopping said motor means and for moving said pressure rolls selectively individually and selectively in unison from said nonfeeding positions to said wire feeding positions whereby, upon discriminative operation of said control means, said apparatus will produce groups of fed wires of varying predetermined lengths with the ends of each wire disposed at any desired location relative to the ends of the longest wire in the group.

2. Apparatus as set forth in claim 1, each of said pressure rolls having engageable and disengageable wire clamping means associated therewith, said clamping means being between said pressure rolls and said endless source means, said clamping means being normally in clamping engagement with said wires, said control means being effective to disengage each of said clamping means when its associated pressure roll is moved to its wire feeding position and being effective to engage each of said clamping means when its associated pressure roll is moved from its wire feeding position to its non-feeding position.

3. Apparatus as set forth in claim 2, said control means comprising program control means.

4. Apparatus as set forth in claim 2, said control means comprising means for accelerating said motor means from rest to and from an operating speed at an ideally constant rate of acceleration.

5. Wire feeding means for feeding a plurality of wires from substantially endless sources, said feeding means comprising:

a feed roll, said feed roll being coupled to motor means for rotating said feed roll, a plurality of pressure rolls, said pressure rolls being rotatably mounted on axis means which extends parallel to the axis of rotation of said feed roll, said pressure rolls being movable individually and in unison between non-feeding positions and feeding positions, said pressure rolls being relatively remote from said feed roll when in said non-feeding positions and being relatively proximate to said feed roll when in said feeding positions, wire guiding means for guiding said wires into the nips defined by said feed roll and said pressure rolls, disengageable wire clamping means for clamping said wires selectively and preventing feeding thereof, control means comprising means for starting said motor means from rest and accelerating said motor means at a high and ideally constant rate to an operating speed, means for decelerating said motor means from said operating speed at a high and ideally constant rate to stop said motor means, means for disengaging said clamping means individually and in unison from said wires and moving said pressure rolls individually and in unison from said non-feeding positions to said feeding positions concomitantly with starting of said motor means, and means for engaging said clamping means individually and in unison and moving said pressure rolls individually and in unison from said feeding positions to said non-feeding positions concomitantly with stopping of said motor means whereby, said wires can be fed individually and in unison from said endless sources upon discriminative operation of said control means to start and stop said motor means, to clamp and unclamp said wires by said clamping means, and to selectively move said pressure rolls between said feeding and non-feeding positions.

6. Apparatus as set forth in claim 5 said control means having program control means.

7. Apparatus as set forth in claim 5, said means for disengaging and engaging said clamping means and for moving said pressure roll between said feeding and non-feeding positions comprising pivoted lever means, said clamping means and said feed rolls being mounted on said lever means, each of said lever means being pivotally movable between a first position, in which its associated clamping means is engaged with its associated wire and its associated pressure roll is in said non-feeding position, and a second position, in which said associated clamping means is disengaged from said wire and said associated feed roll is in said feeding position.

* * * * *